United States Patent [19]

Blecher

[11] Patent Number: 4,463,616

[45] Date of Patent: Aug. 7, 1984

[54] SAMPLE HANDLING APPARATUS

[75] Inventor: Jacob B. Blecher, Lexington, Mass.

[73] Assignee: Instrumentation Laboratory Inc., Lexington, Mass.

[21] Appl. No.: 529,083

[22] Filed: Sep. 2, 1983

Related U.S. Application Data

[63] Continuation-in-part of Ser. No. 361,448, Mar. 24, 1982, abandoned.

[51] Int. Cl.[3] ..... B01L 3/02

[52] U.S. Cl. ..... 73/864.11; 73/864.91; 141/25; 141/382

[58] Field of Search ..... 73/864.01, 864.02, 864.11, 73/864.91; 141/21, 22, 23, 24, 25, 26, 27, 28; 422/100, 102, 382

[56] References Cited

U.S. PATENT DOCUMENTS

| | | | |
|---|---|---|---|
| 3,045,494 | 7/1962 | Gerarde | 73/864.02 |
| 3,228,395 | 1/1966 | Gewecke | 128/214 |
| 3,481,477 | 12/1969 | Farr | 210/359 |
| 3,676,076 | 7/1972 | Grady | 73/864.02 |
| 3,782,414 | 1/1974 | Holbrook | 137/575 |
| 3,785,380 | 1/1974 | Brumfield | 128/276 |
| 3,832,999 | 9/1974 | Crilly | 128/275 |
| 3,965,902 | 6/1976 | Reilly et al. | 128/276 |
| 3,985,032 | 10/1976 | Avakian | 73/864.01 |
| 4,072,330 | 2/1978 | Brysch | 285/239 |
| 4,111,204 | 9/1978 | Hessel | 128/276 |
| 4,118,195 | 10/1978 | Beach | 73/864.11 |
| 4,119,125 | 10/1978 | Elkins | 141/11 |
| 4,250,893 | 2/1981 | White | 128/765 |
| 4,261,474 | 4/1981 | Cohen | 215/250 |
| 4,298,011 | 11/1981 | Mangurten et al. | 128/763 |
| 4,300,404 | 11/1981 | Mehl et al. | 73/863 |
| 4,317,455 | 3/1982 | Akhavi | 128/765 |
| 4,386,933 | 6/1983 | Sanchez | 604/408 |

FOREIGN PATENT DOCUMENTS

| | | | |
|---|---|---|---|
| 2246280 | 9/1974 | France | 128/256 |

*Primary Examiner*—S. Clement Swisher

[57] ABSTRACT

Sample handling apparatus includes a disposable, single use sample vessel that includes reclosable port structure, and coupling structure adjacent said port structure. Cooperating sample transfer structure for detachable connection to the coupling structure of the vessel includes a transfer passage and a port opening probe portion and is movable to a position in which the probe portion opens the reclosable port structure to provide a flow path between the transfer passage and the sample storage vessel. In that position, the vessel and sample transfer structure cooperate to define a sealed chamber that has a flexible, resilient wall.

18 Claims, 18 Drawing Figures

FIG 12
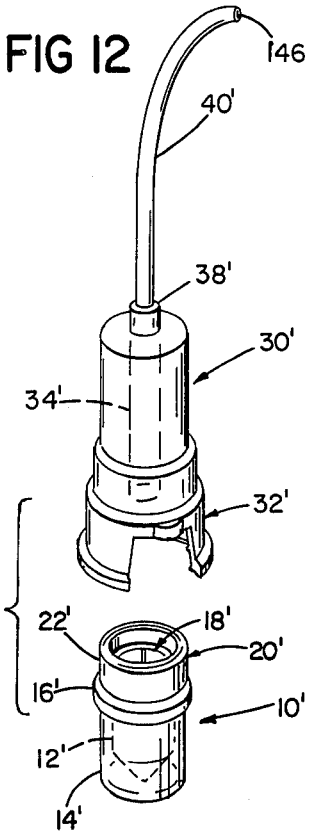
FIG 13
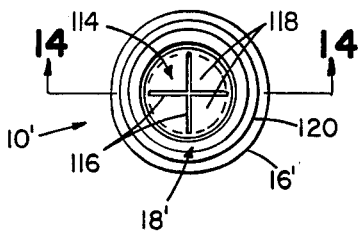
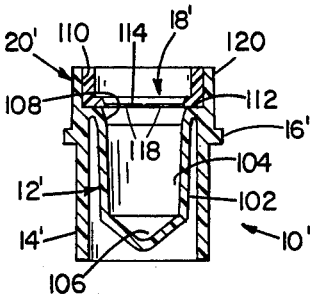
FIG 14
FIG 16
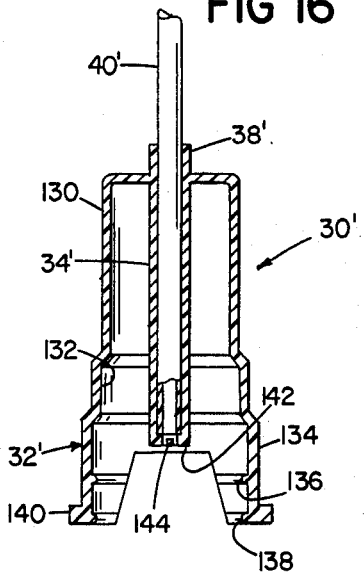
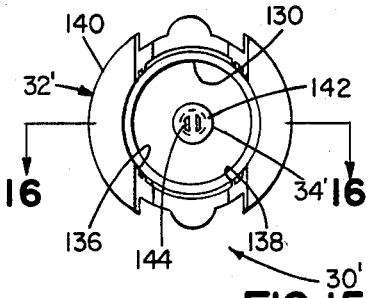
FIG 15
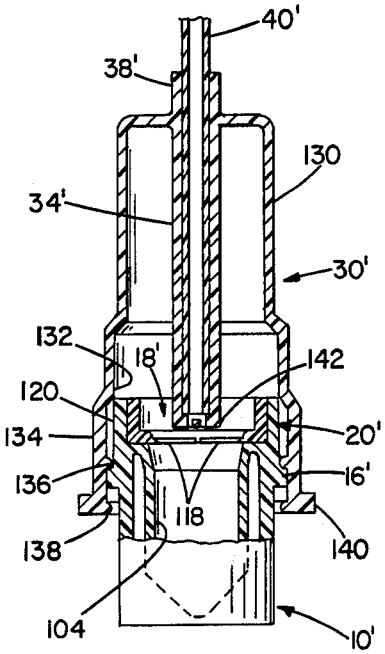
FIG 17
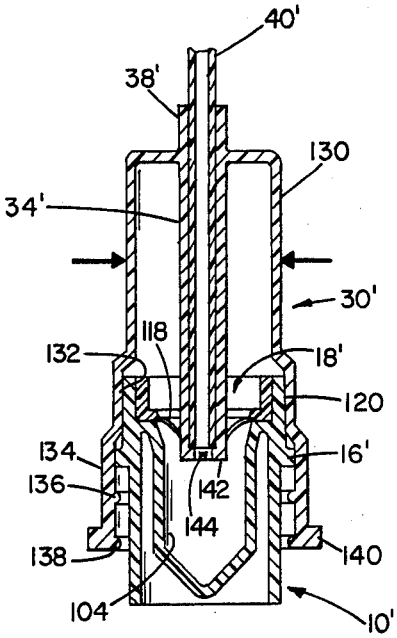
FIG 18

SAMPLE HANDLING APPARATUS

This application is a continuation-in-part of my prior pending application Ser. No. 361,448 filed Mar. 24, 1982 now abandoned.

This invention relates to sample handling apparatus, and more particularly to apparatus for transferring sample portions of biological fluids and the like for analysis.

In the handling of liquids, such as biological fluids, for analysis, a small volume of the liquid is frequently placed in a sample cup which is used to transport the sample through automated analysis equipment and the like. During the laboratory processing of such liquid samples, technicians may be exposed to contamination from the sample liquid itself or indirectly by handling equipment such as pipettes used to transfer the sample liquid to the sample container. In the analysis of blood specimens in the clinical laboratory, a blood sample obtained from a patient may be centrifuged to separate particulate phases, i.e., blood cells, from a fluid phase, i.e., serum or plasma. After centrifuging, the fluid phase of the specimen normally floats as a distinct upper layer from the particulate phase which is concentrated in the lower portion of the container. Frequently it is desirable to withdraw a portion of the separated fluid phase to prevent recombination of the separated phases and to enable analyses of the separated fluid phase to be performed over a prolonged period of time without the need for extracting additional specimen blood from the patient.

In accordance with the invention, there is provided sample handling apparatus that includes a disposable, single use sample vessel which, in preferred embodiments has a volume of less than five milliliters, and cooperating sample transfer structure that includes coupling structure for sealing engagement with the sample vessel so that a sealed chamber is provided. The sample vessel has reclosable port structure and the transfer structure includes a port opening probe portion, the sample transfer structure being movable to a position in which the probe portion opens the reclosable port structure to provide a flow path between the transfer tube and the sample vessel. In that condition, there is a sealed chamber between the transfer tube and the sample vessel, and inward flexing of a wall of that chamber reduces the chamber volume. When the free end of the transfer tube is inserted in a reservoir of sample fluid to be transferred, on release of the flexible wall, resilient action creates a reduced pressure within the chamber which draws liquid from the reservoir through the transfer tube into the sample vessel for storage. After the desired amount of liquid has been transferred, the transfer tube is removed from the reservoir and the sample transfer structure is detached from the sample vessel so that the sample vessel may be handled as a unit with its port essentially closed, providing protection against evaporation and spillage. The sample liquid is protectively stored in a sample vessel which facilitates manual handling as well as manipulation by equipment of automated analysis instrumentation.

In preferred embodiments, the sample transfer structure and the vessel coupling structure have portions for cooperative engagement that are movable relative to one another between a first engaged position in which the port opening probe portion is spaced from the reclosable port structure and a second engaged port position in which the reclosable port structure is opened by the port opening probe portion and a seal is provided so that there is a sealed interconnection between the transfer tube and the sample vessel. Structure is provided for latching the port opening probe portion in its reclosable port structure opening position.

In particular embodiments, the storage vessel has a volume of about one milliliter and has flange structure at its upper end and support structure at its lower end. Extending above the flange structure is a coupling portion of the Luer taper type which mates with a coupling portion on the sample transfer structure. The cover includes an array of flexible flap sectors that close the sample vessel port. Formed integrally in the tranfer tube structure is a filter structure that blocks the flow of particulate matter which might clog an analysis instrument. The base of the sample vessel is of conical well configuration which facilitates maximum extraction of sample material for analysis by an extraction probe. In a first condition, the coupling portions of the vessel and the sample transfer structure are engaged. In use, the coupling portions are slid axially to a second position in which the probe flexes the port cover sectors open and the tapered surfaces provide a chamber seal and are secured in that position by a latch protection. Inward movement of the flexible chamber wall reduces the volume of the chamber and the free end of the transfer tube is inserted in the reservoir from which the sample liquid is to be transferred. On release of the flexible wall, resilient action creates a reduced pressure within the chamber which draws liquid from the reservoir through the transfer tube into the sample vessel for storage. After the desired amount of liquid has been transferred, the transfer tube is removed from the reservoir and the sample transfer structure is detached from the sample vessel so that the sample vessel may be handled as a unit with its port essentially closed, providing protection against evaporation and spillage. In one embodiment, the sample vessel has a flexible wall while in another embodiment, the flexible wall is part of the transfer structure. The sample vessel may be handled with conventional sample cup handling equipment and automated probe apparatus may be employed to remove sample liquid from the vessel as desired for analysis. The sample storage vessel and the sample transfer structure are molded of inexpensive polymeric material and are disposable so that they are appropriate for one time use.

Other features and advantages of the invention will be seen as the following description of particular embodiments progresses, in conjunction with the drawings, in which:

FIG. 12 is a perspective view illustrating a second sample handling system in accordance with the invention;

FIG. 13 is a plan view of the sample vessel component of the system shown in FIG. 12;

FIG. 14 is a sectional view taken along the line 14—14 of FIG. 13;

FIG. 15 is a bottom plan view of the sample transfer component of the system shown in FIG. 12;

FIG. 16 is a sectional view taken along the line 16—16 of FIG. 15;

FIG. 17 is a sectional view of the components of the sample handling system of FIG. 12 in a first assembled position; and FIG. 18 is a sectional view showing the components of the sample handling system of FIG. 12 in a second position and illustrating operation of the system.

DESCRIPTION OF PARTICULAR EMBODIMENTS

Figure 1:
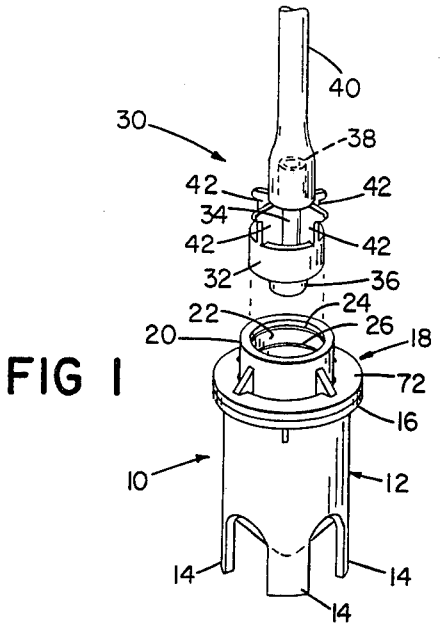
FIG. 1 is a perspective view illustrating a sample handling system in accordance with the invention.

The sample handling system shown in FIG. 1 includes sample receiving vessel 10 that has a cylindrical body component 12 about 1.2 centimeters in diameter and about 1.7 centimeters in height. Vessel 10 has four integral support legs 14 at its base and a flange 16 at its upper end. Cover component 18 is seated on flange 16 in sealing relation. Formed in cover component 18 is a coupling socket 20 that has an annular inner surface 22 (of about 0.8 centimeter diameter) on which two annular latch ribs 24, 26 are formed.

Figure 2:
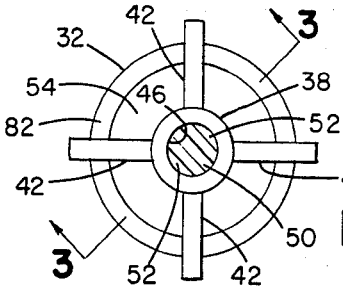
FIG. 2 is a top plan view of the sample transfer component of the system shown in FIG. 1.
Figure 3:
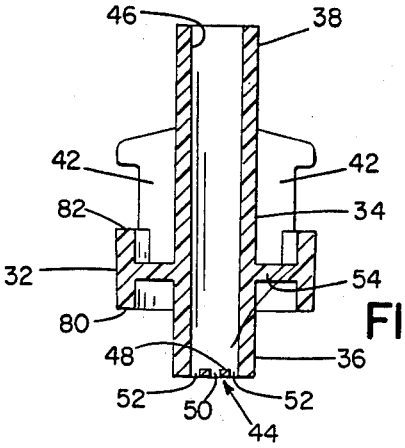
FIG. 3 is a sectional view taken along the line 3—3 of FIG. 2.
Figure 4:
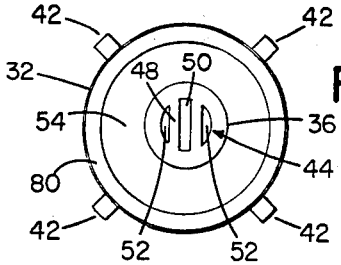
FIG. 4 is a bottom plan view of the sample transfer component.

Cooperating with vessel 10 is a detachable sample transfer unit 30 that includes cylindrical coupling sleeve 32 in which is coaxially disposed tubular through passage structure 34 which terminated in projecting probe 36 at its lower end and has a coupling portion 38 at its upper end to which transfer tube 40 is connected. Integral manipulating tabs 42 extend radially from tubular structure 34. Further details of sample transfer unit 30 may be seen with reference to FIGS. 2–4. Unit 30 is molded of low density polyethylene and its central tubular member 34 has a cylindrical inner surface 46 which defines a through passage about two millimeters in diameter and 1.4 centimeters in length. Filter 44 includes two partitions 48 at the lower end of surface 46 each of about ¼ millimeter in thickness, a rectangular central opening 50 of about 0.4 millimeter width and two arcuate openings 52, each of about 0.3 millimeter maximum width. Coupling sleeve 32 has an axial length of about 3.3 centimeter, a diameter of about 0.8 centimeter with a luer taper of about 1¾ degrees, and is connected to central tube 34 by radial web 54. Manipulating members 42 are integral with and extend radially from tubular structure 34.

Figure 5:
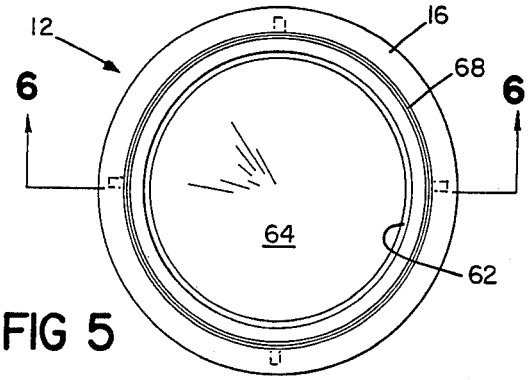
FIG. 5 is a top plan view of the storage vessel component of the system shown in FIG. 1.
Figure 6:
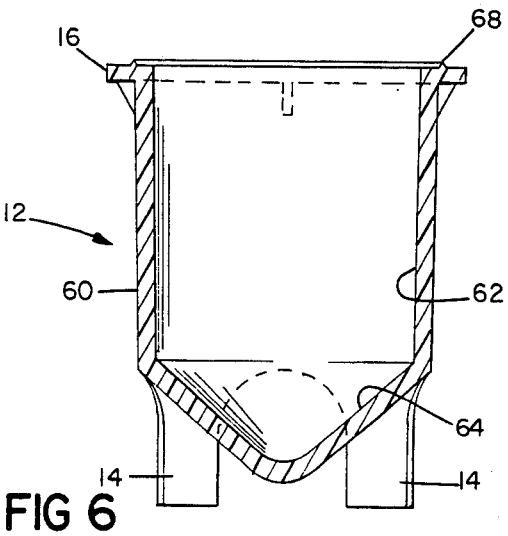
FIG. 6 is a sectional view taken along the line 6—6 of FIG. 5.

Further aspects of vessel body 12 may be seen with reference to FIGS. 5 and 6. Vessel 12 is molded of low density polyethylene and has a flexible cylindrical wall 60 of about 0.6 millimeter thickness that defines a cylindrical chamber surface 62 that is about one centimeter in diameter and about 1.1 centimeters in height. A conical well 64 is formed at the bottom of surface 62, and support legs 14 extend downwardly from wall 60. Legs 14 are about five millimeters in length and provide a stable support with the bottom of well 64 spaced about one millimeter above the surface on which the vessel stands. Flange 16 carries an annular ultrasonic welding ridge 68 that has a diameter of about 1.2 centimeters.

Figure 7:
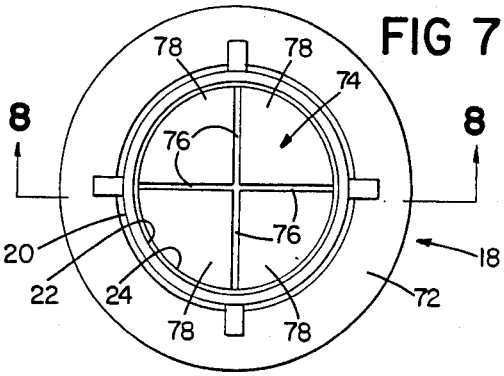
FIG. 7 is a top plan view of the cover component of the system shown in FIG. 1.
Figure 8:
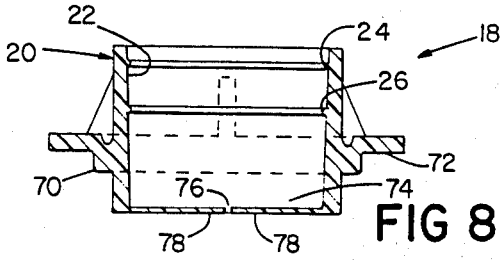
FIG. 8 is a sectional view taken along the line 8—8 of FIG. 7.

Further details of cover component 18 may be seen with reference to FIGS. 7 and 8. That cover has aligning rib structure 70 which is received in the upper end of cylindrical surface 62 and flange 72 which is seated on and sealed to vessel flange 16. Socket structure 20 includes annular surface 22 of about 0.8 centimeter diameter and about 0.7 centimeter axial length with a luer taper at an angle of about 1¾ degrees. Cover membrane 74 at the base of surface 22 has a thickness of about 0.15 millimeter and four radially intersecting slots 76 (each of about 0.1 millimeter width) define four flexible port closure quadrants 78. Annular latch ribs 24 and 26, each of about 0.1 millimeter height, are formed on surface 22 and spaced about two millimeters apart.

Figure 9:
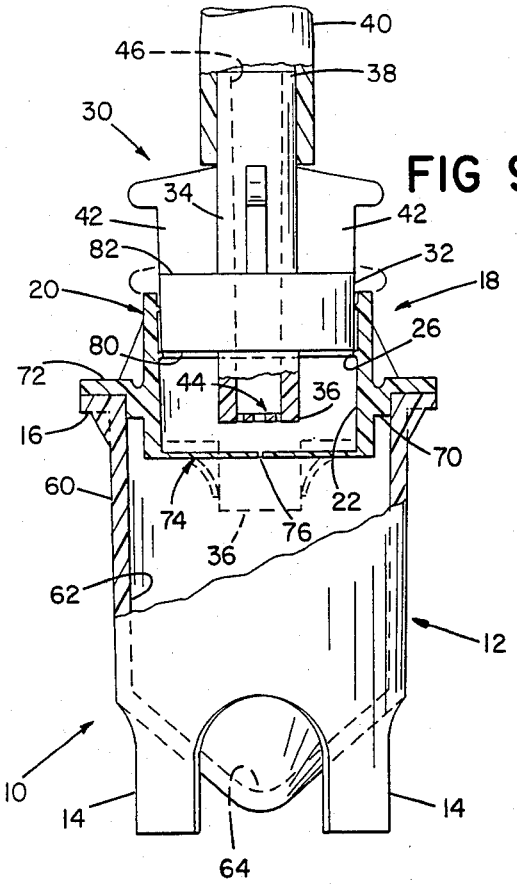
FIG. 9 is a sectional view of the components of the sample handling system in a first assembled position.

A cross-sectional view of the sample transfer system in an initial position is shown in FIG. 9. Flanges 16 and 72 are sealed to provide a sample container of about one milliliter volume with a covered, probe-openable port at the base of coupling socket 20. Sleeve 32 of sample transfer unit 30 is frictionally received in socket surface 22 with its lower edge 80 resting on the lower annular rib 26.

Figure 10:
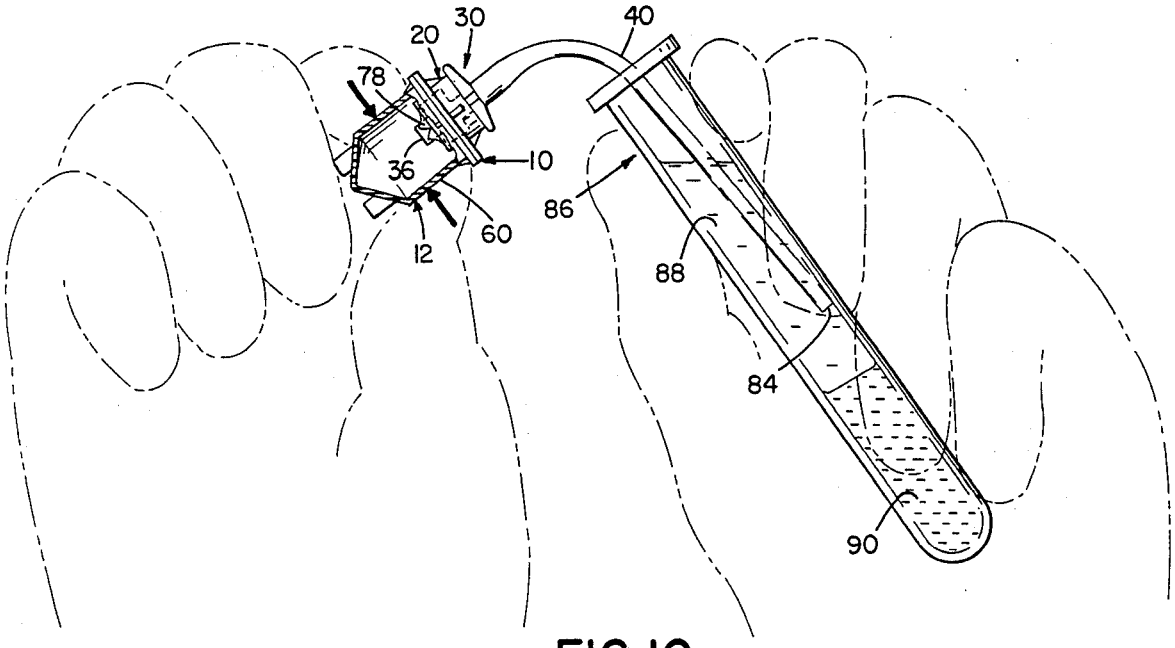
FIG. 10 is a diagrammatic view illustrating operation of the sample handling system.

In use, the sample handling assembly, as shown in FIG. 9, is removed from a sealed protective envelope, and the technician slides sample transfer unit 30 down (an axial travel of about three millimeters) to the dotted line position indicated in FIG. 9 with the upper edge 82 of sleeve 32 being snapped beneath the lower rib 26 to provide an indication that the sample transfer unit is in operative position. In this latched position, tapered surfaces 22, 32 are sealed against each other and probe tip 36 flexes evaporation cover quadrants 78 to open a transfer path between transfer tube 40 and vessel 10. The technician depresses, with finger pressure, the flexible wall 60 (as indicated by the arrows in FIG. 10). With the sample transfer system in that condition, the technician inserts the inlet end 84 into reservoir 86 which contains a plural phase sample—liquid phase 88 being separated from particulate phase 90, as indicated in FIG. 10. Upon release of the finger pressure, the resilient walls 60 move outwardly, creating a reduced pressure in vessel 10 which causes liquid 88 to flow from reservoir 86 into vessel 10. The integral filter 44 removes particulate matter which might interfere with or produce clogging of the analysis instrument.

Figure 11:
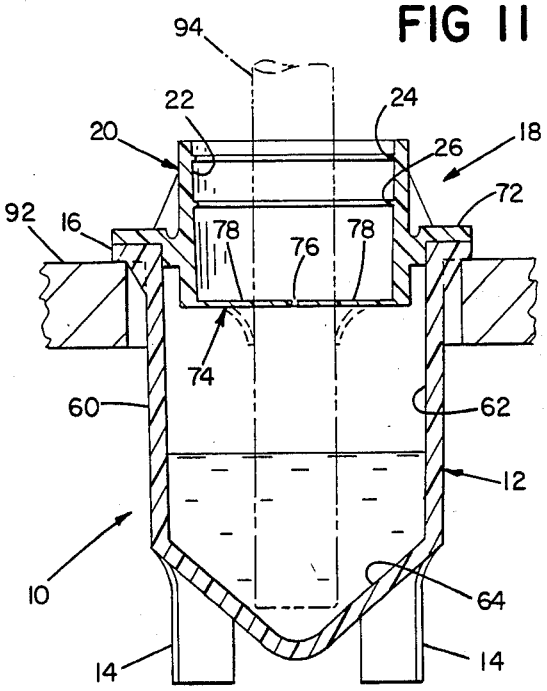
FIG. 11 is a sectional view showing the sample vessel with liquid to be analyzed therein.

When the desired amount of the sample liquid from phase 88 has been flowed from reservoir 86 to vessel 10, transfer tube 40 is removed from reservoir 86 and sample transfer unit 30 is detached from coupling socket 20 of vessel 10. Vessel 10 in this condition, as indicated in FIG. 11, provides a sample container with a stored volume of about one-half milliliter of sample liquid for analysis with a reclosed evaporation cover 74. A suitable sample identification label may be attached to the vessel 10. The vessel is then transferred to the sample tray 92 for the appropriate further analysis—sample liquid 88 being removed from the vessel 10 by means of probe 94 that may be inserted to open the evaporation cover and seated on the base of the chamber as indicated in FIG. 11.

The sample handling system shown in FIG. 12 include a sample receiving vessel 10′ that has a cylindrical body component 12′ and a cylindrical support 14′, a flange 16′, cover component 18′ and a coupling sleeve 20′ that has an annular outer surface 22′ of about 1.3 centimeter diameter.

Cooperating with vessel 10′ is detachable sample transfer unit 30′ that includes cylindrical coupling socket 32′ in which is disposed tubular through passage structure 34′ and has projecting portion 38′ at its upper end which receives transfer tube 40′.

Further details of sample vessel 10′ may be seen with reference to FIGS. 13 and 14. Vessel 10′ is molded of polystyrene and has cylindrical wall 102 of about 0.8 millimeter thickness that defines a cylindrical chamber surface 104 that is about 0.75 centimeter in diameter and about one centimeter in height. A conical well 106 is formed at the bottom of surface 104 and the upper end surface 108 opens outward at about a ten degree angle. Sleeve 14′ provides a stable support for vessel 10′ with the bottom of well 106 spaced about two millimeters above the surface on which the vessel 10′ stands.

Received within socket portion 110 and seated on surface 112 is cover 18′. Membrane 114 has a thickness of about 0.015 millimeter and four radially intersection slots 116 (each of about 0.1 millimeter width) define four flexible port closure quadrants 118. Extending upwardly from flange 16′ is a coupling socket surface 120 that has an axial length of about 0.6 centimeter, a diameter of about 1.4 centimeter and a taper with an angle of about 1¾ degrees.

Further details of detachable sample transfer unit 30′ may be seen with reference to FIGS. 15 and 16. Loader 30′ is molded of polyethylene and has flexible cylindrical chamber wall 130 that has an axial length of about 1½ centimeters and a diameter of about 1½ centimeters. Formed at the base of chamber 130 is coupling sleeve portion 32′ that has an inner surface 132 of about 1.45 centimeter diameter and that tapers at a mating angle of about 1¾ degree. Below coupling sleeve 132 is skirt 134 that has a latch rib 136 formed on its inner surfaces and an external annular flange 140.

A cross-sectional view of the sample transfer system in initial engaged position is shown in FIG. 17. Vessel 10′ provides a container of about one milliliter volume with a covered port at the base of and within coupling sleeve 20′. Coupling socket 134 of sample transfer unit 30′ frictionally receives sleeve 20′ with flange 16′ disposed between latch ribs 136 and 138.

In use, the sample handling assembly shown in FIG. 17 is removed from a sealed protective envelope and the technician slides the sample vessel 10′ into the sample transfer unit 30′ (an axial travel of about one-half centimeter) to the position indicated in FIG. 18 with the upper end of coupling sleeve 120 adjacent the upper end of coupling socket surface 132 and flange 16′ snapped above upper rib 136 to provide an indication that the sample loading system is in operative position. In this latched position, tapered surfaces 120, 132 are sealed against each other and probe tip 142 flexes evaporation cover quadrants 118 to open a transfer path between transfer tube 40′ and vessel 10′. The technician depresses, with finger pressure, the flexible wall 130 (as indicated by the arrows in FIG. 18). With the sample transfer system in that condition, the technician inserts the inlet end 146 of transfer tube 40′ into a reservoir that contains liquid phase to be transferred, similar to as shown in FIG. 10. Upon release of the finger pressure, the resilient walls 130 move outwardly, creating a reduced pressure in the transfer unit-vessel chamber which causes liquid flow from the reservoir into the vessel 10′. The integral filter 144 removes particulate matter which might interfere with or produce clogging of the analysis instrument.

Thus the apparatus facilitates transfer of a portion of a sample for analysis to an analysis vessel without requiring the technician to handle the sample to be analyzed (thus preventing contamination of the sample as well as exposure of the technicial to the sample) through a sample transfer device with an integral filter in which particulate material which might clog the analysis instrument is removed. The cover of the container, after the sample transfer unit is removed, automatically recloses and protects the sample from evaporation, while permitting removal of the sample for analysis.

While particular embodiments of the invention have been shown and described, various modifications will be apparent to those skilled in the art, and therefore it is not intended that the invention be limited to the disclosed embodiments or to details thereof, and departures may be made therefrom within the spirit and scope of the invention.

What is claimed is:

1. Sample handling apparatus comprising a disposable, single use sample vessel and sample transfer structure for detachable connection to said sample vessel, said sample vessel having reclosable port structure and coupling structure adjacent said port structure;

said sample transfer structure having a transfer passage with an opening at one end for insertion into a reservoir of liquid, a port opening probe portion at the end of said transfer passage opposite said one end, and coupling structure cooperating with the coupling structure of the sample vessel, one of said sample vessel and said sample transfer structure having a flexible, resilient wall portion, said sample vessel and said sample transfer structure being movable relative to one another to a position in which said coupling structures are in sealing engagement to provide a sealed chamber between said transfer structure and said sample vessel in which position said probe portion opens said reclosable port structure to provide a flow path between transfer passage and said sample vessel, said sealed chamber being bounded at least in part by said resilient wall portion and said resilient wall portion being compressible to reduce the volume of said chamber and upon release expanding to reduce the pressure within said chamber to draw liquid from a reservoir through said transfer passage into said sample vessel.

2. The apparatus of claim 1 wherein said sample transfer structure and said vessel coupling structures have portions for cooperative engagement, said cooperative engagement portions being movable relative to one another between a first engaged position in which said port opening probe portion is spaced from said reclosable port structure and a second engaged position in which said reclosable port structure is opened by said port opening probe portion.

3. The apparatus of claim 2 and further including latch structure for latching said port opening probe portion in said reclosable port structure opening position.

4. The apparatus of claim 1 wherein said coupling structures of said vessel and said sample transfer structure include cooperating socket structure and sleeve structure dimensioned to mate with each other.

5. The apparatus of claim 4 wherein said socket and sleeve structures are of the luer taper type.

6. The apparatus of claim 4 and further including axially spaced latch members on the wall of said socket structure.

7. The apparatus of claim 6 wherein said reclosable port structure includes a flexible flap portion.

8. The apparatus of claim 7 wherein said sample transfer structure includes structure defining a through passage that extends between said port opening probe and a transfer tube, and further including filter structure in said through passage.

9. The apparatus of claim 1 wherein said sample storage vessel has a volume of less than five milliliters.

10. The apparatus of claim 1 wherein said sample vessel has a flexible resilient cylindrical wall and the base of said sample vessel is of conical well configuration.

11. The apparatus of claim 10 wherein said reclosable port structure includes a flexible flap portion and further including latch structure for latching said port opening probe portion in position opening said reclosable port structure.

12. The apparatus of claim 11 wherein said sample storage vessel has a volume of about one milliliter, said sample transfer structure includes structure defining a through passage that extends between said port opening probe and a flexible transfer tube, and further including filter structure in said through passage.

13. The apparatus of claim 1 wherein said flexible wall portion is part of said vessel.

14. The apparatus of claim 1 and further including latch structure for latching said port opening probe portion in said reclosable port structure opening position.

15. The apparatus of claim 1 wherein said reclosable port structure includes a flexible flap portion.

16. The apparatus of claim 1 wherein said sample transfer structure includes structure defining a through passage that extends between said port opening probe and a transfer tube, and further including filter structure in said through passage.

17. The apparatus of claim 1 wherein said flexible wall portion is part of said sample transfer structure.

18. The apparatus of claim 17 wherein said sample vessel has a volume of less than five milliliters, said reclosable port structure includes a flexible flap portion, and further including filter structure in said through passage and latch structure for latching said probe portion in position opening said flexible flap portion.

* * * * *